United States Patent [19]

Entwistle

[11] Patent Number: 4,750,866

[45] Date of Patent: Jun. 14, 1988

[54] CONTROL DEVICE FOR A PUMP WITH ADJUSTABLE FLOW

[75] Inventor: Richard T. Entwistle, Ollundsbjerg, Denmark

[73] Assignee: Danfoss A/S, Nordborg, Denmark

[21] Appl. No.: 945,819

[22] Filed: Dec. 24, 1986

[30] Foreign Application Priority Data

Jan. 14, 1986 [DE] Fed. Rep. of Germany ..... 3600787

[51] Int. Cl.[4] ..... F04B 49/00

[52] U.S. Cl. ..... 417/216; 417/217; 417/218

[58] Field of Search ..... 417/212, 216–220, 417/222; 60/447

[56] References Cited

U.S. PATENT DOCUMENTS

| | | | |
|---|---|---|---|
| 3,985,472 | 10/1976 | Virtue et al. | 417/216 |
| 4,216,656 | 8/1980 | Hamma | 60/447 X |
| 4,432,703 | 2/1984 | Beutler et al. | 417/217 |
| 4,436,489 | 3/1984 | Zangenberg | 417/218 |
| 4,559,778 | 12/1985 | Krusche | 60/447 |

FOREIGN PATENT DOCUMENTS

| | | | |
|---|---|---|---|
| 1528434 | 9/1969 | Fed. Rep. of Germany | 417/217 |
| 2925236 | 1/1981 | Fed. Rep. of Germany | 417/218 |
| 3339165 | 5/1985 | Fed. Rep. of Germany | 417/218 |
| 228783 | 11/1985 | Japan | 417/218 |
| 1883 | 1/1986 | Japan | 417/216 |
| 1090915 | 5/1984 | U.S.S.R. | 417/218 |

*Primary Examiner*—Carlton R. Croyle
*Assistant Examiner*—Paul F. Neils
*Attorney, Agent, or Firm*—Wayne B. Easton; Clayton R. Johnson

[57] ABSTRACT

The invention relates to a pump assembly having a pump with reversible and adjustable controls, the pump controls having a neutral nonflow position and varying positions in opposite directions for effecting corresponding varying rates of flow in the opposite directions. The pump controls include a control valve for the adjusting function which is cooperable with resetting apparatus.

10 Claims, 1 Drawing Sheet

A
B
$P_p$
$P_1$
$P_2$
$P_3$
$P_4$
$P_5$

CONTROL DEVICE FOR A PUMP WITH ADJUSTABLE FLOW

The invention relates to a control device for a pump with adjustable flow, comprising an adjusting apparatus having a zero position and, to both sides thereof, zones with increasing flow in opposite directions and a stepped piston of which the smaller piston area can be subjected to the pump pressure and the larger piston area in the opposite direction to a control pressure feedable by a control pressure conduit, and comprising a control valve having two oppositely adjustable throttles connected in series between the pump pressure conduit and the vessel and, between the throttles, a tapping for the control pressure.

Control devices of this kind are known from DE-OS No. 29 25 236. The stepped piston always assumes a position in which the forces acting on it from both sides are in equilibrium. By changing the control pressure, the position of the adjusting apparatus is therefore altered. The control valve is actuatable by hand and comprises a resetting apparatus mechanically coupled to the adjusting apparatus. Neutral position springs ensure that, in the unactuated condition, the control valve always produces a control pressure corresponding to the neutral position or zero position. Such a control device must be disposed in the immediate vicinity of the pump and be accessible for manual actuation.

The invention is based on the problem of providing a control device of the aforementioned kind in which there is greater freedom as far as the disposition of the control valve is concerned. This problem is solved according to the invention in that the control valve is provided for its actuation with a servo input connected by way of a servo conduit to a servo pressure generator, that a safety valve severs the servo input from the servo conduit in case of a fault and connects it to an auxiliary conduit extending from a resetting pressure generator, and that the resetting pressure generator can be actuated depending on the position of the adjusting apparatus and, until reaching the zero position, delivers a resetting pressure of such a size that the control valve is moved in a direction driving the adjusting apparatus to the zero position.

Such a control valve can have any desired position. It need not be manually actuated because it can be operated by way of the servo conduit. Within the scope of this servo control, it is of course also possible to bring the adjusting apparatus to the zero position. However, if the servo control fails or some other fault occurs, the pump would continue to run out of control. In this case of a fault, the claimed safety valve takes effect by connecting the servo input of the control valve to the resetting pressure generator by way of the auxiliary conduit. Since the resetting pressure depends on the position of the adjusting apparatus, it forms a feedback permitting the adjusting apparatus to be brought to the zero position in a controlled manner and to be retained in this position so that there will be no uncontrolled flow of pressure medium. For this manner of operation, it is similarly not necessary to locate the control valve in close proximity to the pump.

For which faults the safety valve will respond depends on the design of the control device. For example, there may be a missing or low pump pressure, failure of the servo pressure pump, positional error or excessively rapid movement of the adjusting apparatus, and so on.

Preferably, the resetting signal generator is a pressure divider which is adjustable by the adjusting apparatus, fed by an operating pressure, comprises oppositely adjustable throttles and a tapping therebetween for the resetting pressure, and, depending on the position of the adjusting apparatus, delivers either the operating pressure or the pressure of the vessel or an intermediate pressure as the resetting pressure. Accordingly, with a positional change of the adjusting apparatus, the resetting signal will also change at least in the zone of the zero position.

In particular, the operating pressure may be formed by the control pressure. Since the control pressure is generally lower than the pump pressure, the losses in the pressure divider will be correspondingly low.

Another advantage is obtained if the stepped piston is provided adjacent to the end wall that forms the larger piston area with a cavity connected to the vessel, a pin coaxially applied to the cylinder of the stepped piston passes through an aperture in the end wall, and the pin is provided with control orifices which form the pressure divider in conjunction with the end wall. In this case, the control pressure can be derived directly from the control pressure chamber of the stepped cylinder. The pressure divider has a very simple construction.

It is advisable for the control orifices to project beyond both sides of the end wall. In this way, one obtains the two oppositely adjustable throttles of the pressure divider. This leads to very accurate control during resetting in the region of the zero position. Alternatively, the control orifice can have a shorter axial length so that the throttling positions are at least partially produced by the annular gap between the pin and the bore in the end wall.

It is favourable for the pin to be provided with at least one radial bore extending from the control orifice and an axial bore connected to the auxiliary conduit. Since the pin is stationary, a simple connection is obtained to the auxiliary conduit.

The control orifice may be formed by the mouth of the radial bore. However, it is preferably defined by an axial throttle groove. Another alternative is the provision of a very flat circumferential groove.

With particular advantage, the control pressure conduit is provided with a throttle. This throttle ensures that resetting of the adjusting apparatus into the zero position does not take place suddenly but gradually.

In particular, the throttle may be bridged by a change-over valve, which blocks in case of a fault. The delay effect is therefore provided only for automatic resetting to the zero position but will not interfere with the normal control operation.

The safety valve and the change-over valve may be combined to form a valve arrangement with a common setting element. This simplifies the construction.

The invention will now be described in more detail with reference to preferred examples shown in the drawing, wherein.

Figures 1, 2, 3:
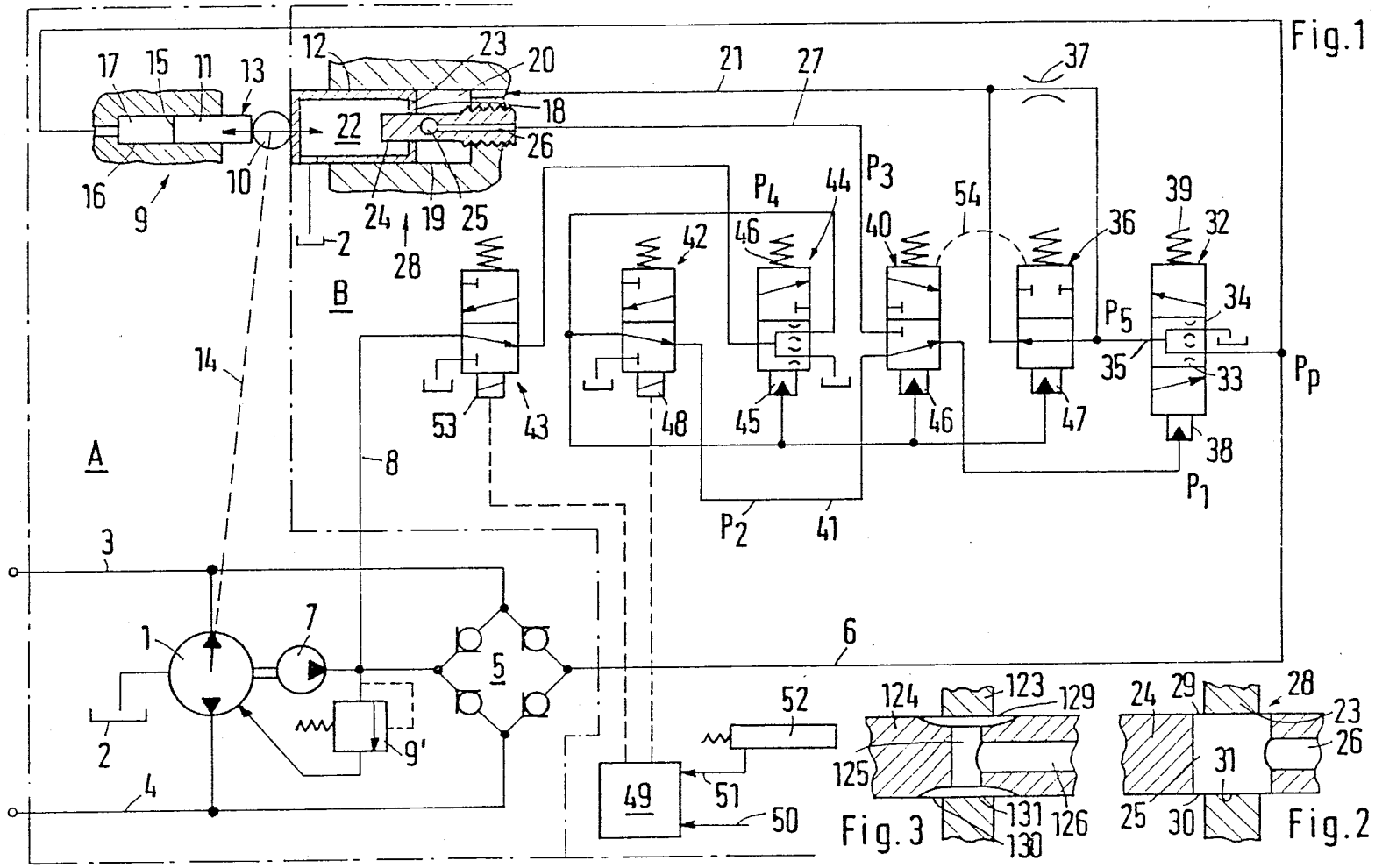
FIG. 1 is a diagrammatic circuit diagram of the control device according to the invention.
FIG. 2 is a partial longitudinal section through the resetting pressure generator and FIG. 3 is a partial longitudinal section through a modified form of resetting pressure generator.

FIG. 1 illustrates a pump 1 which sucks oil from a vessel 2 and can deliver it selectively by way of the one or other supply conduit 3 or 4 to a consumer (not shown). By way of a bridge circuit 5 consisting of check valves, both conduits are connected to a pump pressure conduit 6 which is at pump pressure $P_p$. A servo pump 7 coupled to the pump 1 conveys pressure fluid by way of a conduit 8 into a servo circuit and, when required, by way of the bridge circuit 5 to the supply conduit 3 or 4. The pressure of the servo pump 7 is fixed by a pressure limiting valve 9'.

The pump 1 has an adjusting apparatus 9 with the aid of which the quantity of flow, starting from a zero position, can be adjusted up to a maximum flow through the supply conduit 3 on the one hand and up to a minimum flow through the supply conduit 4. It may be a radial or axial piston pump with an adjustable piston or track carrier, a vane pump with adjustable eccentric ring, or any other desired two-directional pump with adjustable flow. The adjusting apparatus 9 comprises an entrainment member 10 disposed between the sections 11 and 12 of a stepped piston 13. The entrainment member 10 is connected by way of the coupling 14 shown in broken lines directly to the aforementioned carrier, eccentric ring or another control element. The section 11 has a smaller piston area 15 in a cylinder 16 of which the cylinder chamber 17 is connected to the pump pressure conduit 6. The section 12 has a larger piston area 18 in a cylinder 19 of which the cylinder chamber 20 is connected to a control pressure conduit 21 at control pressure $P_s$.

The piston section 12 has a cavity 22 which is connected to the vessel 2. Its end wall 23 is penetrated by a pin 24 having a throughgoing radial bore 25 and an axial bore 26 which is connected to an auxiliary conduit 27. The end wall 23 and pin 24 form a resetting pressure generator 28 in the form of a pressure divider of which the construction is more clearly explained in FIG. 2. The two mouths of the radial bore 25 form control orifices 29 and 30 and, in the zero position of the adjusting apparatus 9, project at both sides beyond the orifice 31 in the end wall 23 that is penetrated by the pin 24. This creates two throttles adjustable in opposite senses until the one or other throttle is completely closed.

The FIG. 3 embodiment is much the same and therefore corresponding parts are provided with reference numerals increased by 100. The difference is that the control orifices 129 and 130 are formed by flat axial grooves forming throttle passages, so that still finer adjustment of the throttling effect and hence smoother control are achieved.

Between the pump pressure conduit 6 and the vessel, a control valve 32 comprises two series-connected throttles 33 and 34 adjustable in opposite senses as well as a tapping 35 therebetween at which the control pressure $P_s$ can be derived depending on the one hand on the pump pressure and on the other hand on the position of the control valve 32. The control pressure $P_s$ is led by way of a change-over valve 36 or, when the latter is closed, by way of a throttle 37 and the control pressure conduit 21 to the cylinder space 20. The control valve 32 comprises a servo input 38 by way of which a servo pressure $P_1$ is supplied which acts against the force of a spring 39 and, for example, adjusts a valve piston of the control valve 32.

A safety valve 40 which responds in case of a fault connects the servo input 38 normally to a servo conduit 41 and, in case of a fault, to the auxiliary conduit 27. The pressure $P_1$ at the servo input 38 therefore corresponds either to the servo pressure $P_2$ or to the resetting pressure $P_3$.

To produce the servo pressure, the servo pump 7 is connected to a constant pressure regulator 44 by way of a fault valve 43. Its output pressure $P_4$ is applied to its servo input 45 so that the pressure $P_4$ has a constant value depending on the force of spring 46. The same pressure $P_4$ is also fed to the servo input 46 of the safety valve 40 and the servo input 47 of the change-over valve 36. Further, the pressure $P_4$ serves as an input value for the servo pressure generator 42 of which the electromagnet 48 is influenced by an electronic control and regulating circuit 49 in the sense of impulse width modulation. The servo pressure $P_2$ is therefore less than the constant pressure $P^4$. The control and regulating apparatus 49 is fed on the one hand at the input 50 with a desired value for the desired amount of flow and at the input 51 with an existing value for the actual position of the adjusting apparatus 9, in the present case with the aid of a position detector 52. The control and regulating apparatus 49 is also able to recognize faults and in that event to energize the electromagnet 53 of the fault valve 43 so that the latter disconnects the input of the constant pressure valve 44 from the servo pump 7 and applies it to the vessel 2.

The following operation is obtained. During normal operation, the control valve 32 is governed by the servo pressure $P_2$ which is prescribed by the control and regulating apparatus 49 with the aid of the servo pressure generator 42. The control pressure $P_s$ in the cylinder space 20 acts on the larger piston area 18 whilst the pump pressure $P_p$ in the cylinder space 17 acts on the smaller piston area 15. Under the influence of the control pressure, the adjusting apparatus 9 is moved until the pump pressure $P_p$ has attained a value at which the stepped piston 13 is held in equilibrium. Every change in the control pressure brought about by the control and regulating apparatus 49 leads to a corresponding adjustment of the adjusting apparatus. If the servo pump 7 fails or the fault valve 43 is switched over, the constant pressure $P_4$ drops to the pressure of the vessel.

Consequently, the safety valve 40 as well as the change-over valve 36 move to the other position. The resetting pressure $P_3$ now acts on the servo input 38 of the control valve 32. If the adjusting apparatus 9 has the position shown in FIG. 1, the resetting pressure $P_3$ is equal to the control pressure $P_s$ with the result that this control pressure is reduced by the control valve 32 and the adjusting apparatus 9 moves to the right. As soon as the control orifices 29 and 30 are disposed in the region of the end wall 23, the pressure dividing function of the resetting pressure generator 28 sets in, with the result that the resetting pressure $P_3$ is now only a fraction of the control pressure $P_s$. As soon as a particular ratio has been achieved between the control pressure and resetting pressure, the adjusting apparatus is disposed in the zero position and is held in this zero position. Corresponding conditions arise when the control orifices 29 and 30 were initially in the cavity 22 but in that case the control valve 32 is so influenced that the adjusting apparatus 9 moves to the left.

An arc 54 shown in broken lines indicates that the two valves 36 and 40 may have a common valve slide and hence also a common servo input. The constant pressure regulator 44 may also be included in this valve combination. The components disposed within the region A bounded by chain dotted lines are those belonging to the fittings with which a pump is normally equipped. It is only the parts in the zone B that have to be changed or replaced.

I claim:

1. A pump assembly comprising a reversible adjustable flow pump, a flow control for said adjustable pump having a neutral nonflow position and varying positions in opposite directions for effecting corresponding varying rates of flow in said directions, a continuously running servo pump, discharge tank means, pump adjusting apparatus including stepped piston means having first and second oppositely facing effective areas and being operatively connected to said pump control, pump pressure conduit means connected to said servo pump and to said adjusting apparatus in fluid communication with said first effective area, control pressure conduit means connected to said pump adjusting apparatus in fluid communication with said second effective area, control valve means having a servo input, said control valve means having first and second oppositely adjustable throttles connected to said control pressure conduit means with said first throttle being connected to said pump pressure conduit means and said second throttle being connected to said tank means, electronic regulating means for receiving a desired flow rate input signal and a reference position input signal connected to said pump flow control, an electromagnetic servo pressure generator having an electromagnetic servo input and being connected between said servo pump and said control valve means servo input, said electronic regulating means having an output signal connected to said electromagnetic servo input of said electromagnetic servo pressure generator.

2. A pump assembly according to claim 1 including resetting pressure generator means cooperable with said pump adjusting apparatus and being connected to said control valve means servo input, said resetting pressure generator means being responsive to the position of said adjusting apparatus for delivering a resetting pressure of a magnitude so that said control valve means is moved in a direction driving said adjusting apparatus to said neutral position.

3. A pump assembly according to claim 2 including a safety valve for selectively connecting said electromagnetic servo pressure generator and said resetting pressure generator to said control valve means servo input.

4. A pump assembly according to claim 2 including an auxiliary conduit extending from said resetting pressure generator means to said control valve means servo input.

5. A pump assembly according to claim 4 wherein said auxilliary conduit includes a flow control throttle.

6. A pump assembly according to claim 5 including a change-over valve bridging said flow control throttle which blocks in case of a fault.

7. A pump assembly according to claim 2 wherein said resetting pressure generator means has oppositely adjustable throttle means between said control pressure conduit means and said control valve means servo input, said oppositely adjustable throttle means being operative depending on the position of said adjusting apparatus to deliver a range of pressures between the pressure in said control pressure conduit means and the pressure of said discharge tank means.

8. A pump assembly according to claim 7 wherein said pump adjusting apparatus includes first and second cylinders and said stepped piston means includes first and second pistons in said cylinders, said second piston having a bore opening towards said second cylinder, a pin extending through said second cylinder and being in sliding and relatively moveable relation to said bore, drain means in said second piston providing fluid communication between said bore and said discharge tank means, said oppositely adjustable throttle means being between said pin and said bore, and conduit means in said pin connecting said throttle means to said control valve means servo input.

9. A pump assembly according to claim 8 wherein said adjustable throttle means include a transverse bore in said pin, said second piston being moved so that said transverse bore is in full communication with said discharge tank means when said adjusting means is in said neutral position.

10. A pump assembly according to claim 9 wherein said adjustable throttle means include axially extending grooves in said pin at opposite ends of said transverse bore.

* * * * *